US010870898B2

(12) United States Patent
MacRae

(10) Patent No.: US 10,870,898 B2
(45) Date of Patent: Dec. 22, 2020

(54) STAVE COOLER WITH COMMON COOLANT COLLAR

(71) Applicant: MacRae Technologies, Inc., Hayward, CA (US)

(72) Inventor: Allan J. MacRae, Hayward, CA (US)

(73) Assignee: MACRAE TECHNOLOGIES, INC, Hayward, CA (US)

( * ) Notice: Subject to any disclaimer, the term of this patent is extended or adjusted under 35 U.S.C. 154(b) by 133 days.

(21) Appl. No.: 16/267,352

(22) Filed: Feb. 4, 2019

(65) Prior Publication Data

US 2019/0256936 A1 Aug. 22, 2019

Related U.S. Application Data

(63) Continuation-in-part of application No. 13/147,996, filed on Dec. 23, 2011, now abandoned, and a continuation-in-part of application No. 16/101,418, filed on Aug. 11, 2018, now Pat. No. 10,364,475, and a continuation-in-part of application No. 15/882,843, filed on Jan. 29, 2018, which is a continuation-in-part (Continued)

(51) Int. Cl.

| | |
|---|---|
| ***C21B 7/10*** | (2006.01) |
| ***F27B 1/24*** | (2006.01) |
| ***F27D 1/12*** | (2006.01) |
| ***F27B 3/24*** | (2006.01) |
| ***C21C 5/46*** | (2006.01) |
| *F28D 1/06* | (2006.01) |
| *F27D 9/00* | (2006.01) |

(52) U.S. Cl.

CPC ..... *C21B 7/10* (2013.01); *C21C 5/4646* (2013.01); *F27B 1/24* (2013.01); *F27B 3/24* (2013.01); *F27D 1/12* (2013.01); *F27D 2009/0048* (2013.01); *F28D 1/06* (2013.01)

(58) Field of Classification Search

CPC . C21B 7/10; C21C 5/4646; F27B 1/24; F27B 3/24; F27D 1/12; F27D 2009/0048

USPC ..... 266/190, 193, 44, 241, 168, 46, 194; 29/428; 165/168, 170, 169; 432/83

See application file for complete search history.

(56) References Cited

U.S. PATENT DOCUMENTS 4,398,701 A * 8/1983 Cordier ..... C21B 7/10 266/193

6,280,681 B1 8/2001 MacRae (Continued)

FOREIGN PATENT DOCUMENTS

EP 0025132 * 3/1981 ..... C21B 7/10

EP 0025132 A1 3/1981

*Primary Examiner* — Jessee R Roe

*Assistant Examiner* — Michael Aboagye

(74) *Attorney, Agent, or Firm* — Main Law Cafe; Richard B. Main

(57) ABSTRACT

All of a cast-iron or cast-copper stave cooler's weight is supported inside a furnace containment shell by a single gas-tight steel collar on its backside face. All the coolant piping in each cooler has every external fluid connection collected and routed together through the one steel collar. A wear protection barrier is disposed on the hot face. At least one of horizontal rows of ribs and channels retain metal inserts or refractory bricks, or pockets that assist in the retention of castable cement and/or accretions frozen in place from a melt, or an application of an area of hardfacing that is welded on in bead, crosshatch, or weave pattern.

5 Claims, 7 Drawing Sheets

Related U.S. Application Data of application No. 15/815,343, filed on Nov. 16, 2017, now Pat. No. 9,963,754, and a continuation-in-part of application No. 13/148,003, filed on Dec. 23, 2011, now Pat. No. 10,247,477.

(60) Provisional application No. 61/318,977, filed on Mar. 30, 2010, provisional application No. 62/701,832, filed on Jul. 22, 2018.

(56) References Cited

U.S. PATENT DOCUMENTS

| | | | | |
|---|---|---|---|---|
| 8,834,784 | B2 | 9/2014 | MacRae | |
| 9,121,076 | B2 * | 9/2015 | Smith | F27D 1/0003 |

* cited by examiner up 111a 110a
113a 112a
113b 112b
111b 110b
common
opening
116
weld
115
100 stave cooler
102 metal panel
114
120
122
brick
124
horizontal ribs
and grooves
in hot-face
104
furnace steel
containment
shell
108, 110-113
pipe circuit and
loops of cooling pipe

STAVE COOLER WITH COMMON COOLANT COLLAR

APPLICATION'S CROSS REFERENCE TO RELATED APPLICATIONS

This application Ser. No. 16/267,352 (Feb. 4, 2019) is a CIP of Ser. No. 16/101,418 (Aug. 11, 2018) now U.S. Pat. No. 10,364,475, which relates to single steel coolant-collar penetrations of cast-iron and cast-copper stave coolers in furnace steel containment shells, which is a CIP of Ser. No. 15/815,343 (Nov. 16, 2017) now U.S. Pat. No. 9,963,754 (May 8, 2018), U.S. Pat. No. 9,963,754, that related to "improved stave coolers that each hang together inside steel shelled furnaces by a single neck extended out through a steel jacketed collar", and has "a body of cast copper alloyed to balance its thermal conductivity, pipe bonding, strength, and small grain properties", and which claims benefit of provisional 62/701,832 (Jul. 22, 2018);

This application Ser. No. 16/267,352 (Feb. 4, 2019) is a CIP of application Ser. No. 13/148,003 (Dec. 23, 2011), now U.S. Pat. No. 10,247,477 (Apr. 2, 2019) which is related to "at least one cooling fluid inlet and at least one cooling fluid outlet for the flow of cooling fluid to and from the plate cooler stave from outside the furnace", which is a 371 of PCT/US2011/030611 (Mar. 30, 2011); and This application Ser. No. 6/267,352 (Feb. 4, 2019) is a CIP of Ser. No. 13/147,996 (Dec. 23, 2011) which is related to staves with water pipes in supporting coaxial protection pipes with gas-tight seals, which is a 371 of PCT/US11/030591 (Mar. 30, 2011), which claims benefit of Provisional 61/318,977 (Mar. 30, 2010), related to gas-tight seals of flared, steel protection pipes embedded into a stave body around stave coolant water pipes.

FIELD OF INVENTION

The present invention relates to stave coolers for circular furnaces with steel containment shells, and more particularly to cast-iron and cast-copper stave coolers with a single penetration required of a steel containment shell to accommodate a steel collar that entirely supports the weight of the stave cooler inside smelting furnaces, and that passes all the piping inlets and outlets through in one group for liquid cooling. The object of constructing the steel collars this way being to reduce compensator and fastener failures of stave coolers at work in in furnace containment shells.

BACKGROUND

Ferrous and non-ferrous metals are being smelted throughout the world in circular furnaces with steel containment shells. Some of these employ panel type stave coolers to cool behind refractory bricks mounted to their hot faces. Many such panel type stave coolers and bricks arranged in rows along stacked horizontal rings form a complete inner liner that can survive for years of continuous operation.

Liquid coolants are circulated through each stave cooler with clusters of piping that passes through penetrations of the steel containment shells to access an external heat exchanger. Every penetration of the steel containment shell must be sealed to keep the hazardous process gases both inside the furnace and away from its operating personnel. So the fewer penetrations the better.

Production rates exceeding three tons of hot metal per cubic meter of working volume per day are now being reached with modern blast furnaces. This was made possible by using improved burden materials, better burden distribution techniques, tighter process controls, very high hot-blast temperatures, oxygen enrichment technology, pulverized-coal injection, and natural gas fuel enrichment. All of which result in much higher average heat loads and fluctuations that land on the stave coolers mounted inside the steel containment shells of up-to-date blast furnaces.

Integrated steelworks use blast furnaces to supply themselves the pig iron they use to make steel. The large gains being made in furnace-productivity have also placed overwhelming demands on cooling system capacities. The liquid-cooled stave coolers in blast furnaces first developed in the late 1960's became inadequate. High conductivity copper stave coolers have been needed since the late 1970's because these are better able to deal with the intense process heats now being generated in state-of-the-art, high stress furnaces. Copper stave coolers have also proved themselves capable of delivering furnace campaign lives that now exceed fifteen years.

The average thermal load levels a stave cooler will be subjected to depends on where it will be positioned within a blast furnace and how the furnace is operated. See FIG. 1. Cast-iron staves can still be successfully used in the less demanding middle and upper stack areas of blast furnaces, but the much higher average heat loads below in the lower stack, Belly, Bosh, Tuyere Level, and Hearth all require the use of higher performing, but more costly copper staves.

Cast iron staves are less efficient at cooling than are copper staves because the cast iron metal is relatively much lower in thermal conductivity. Their inherent thermal resistance allows heat to pile up too high if too much loading is presented. Poor internal bonding can add unnecessarily to the overall thermal resistance. Otherwise, cracks develop in the cast iron and the cracking can propagate into the steel pipes themselves. Cast iron staves have a de-bonding layer that adds to a thermal barrier between coolants circulating in its internal water-cooling tubes and the hot faces of the cast iron stave body. Both such effects conspire in reducing the overall heat transfer abilities of cast iron staves.

Such inefficiencies in cast iron stave heat transfer performance can overstress cast iron staves when hot face temperatures drive up over 700° C. Thermal deformations are hard to avoid. Cast iron stave bodies can also suffer phase-volume transformations when operated at very elevated temperatures. Fatigue cracking, stave body material spalling, and cooling pipes exposed directly to the furnace heat are common failures. Stave coolers can also be used in reduction vessels for the production of direct reduced iron (DRI).

When liquid-cooled stave coolers are disposed inside the steel containment shells of smelting furnaces, each conventional coolant connection must have a corresponding penetration or access window in the shell in order to complete the hose connections outside. And, conventionally, each stave cooler must be bolted to or otherwise mechanically attached to the steel containment shell to provide vertical support to itself and the refractory brick lining it supports and cools on its hot face.

The hot smelting inside the furnaces produces very hot, toxic, and often flammable process gases that will find escape paths between the refractory bricks, and between the stave coolers and out through any openings in the containment shell. So these penetration points must have good gas seals. One penetration is easier to seal and keep sealed than several. While two or more fixed points will lead to thermally induced mechanical stresses.

But because the stave coolers, containment shells, and refractory brick are all subject to thermal expansion forces, the gas seals can be compromised over the campaign years by constantly being worked back and forth. Stave coolers can have many independent circuits of coolant piping inside, and each produces pairs of coolant connection ends that must be passed out back and through the containment shell.

SUMMARY

Briefly, cast-iron and cast-copper stave cooler embodiments of the present invention have all of the stave cooler's weight supported inside a furnace containment shell by a single gas-tight steel collar on the backside. All the coolant piping in each cooler has every external connection collected and routed together through the one steel collar. A wear protection barrier is disposed on the hot face. Such is limited to include at least one of horizontal rows of ribs and channels that retain metal inserts or refractory bricks, or pockets that assist in the retention of castable cement and/or accretions frozen in place from a melt, or an application of an area of hardfacing that is welded on in bead, crosshatch, or weave patterns.

DETAILED DESCRIPTION OF THE EMBODIMENTS

Iron smelting furnaces operate in highly reducing environments and produce dangerous levels of toxic and highly flammable carbon monoxide (CO) gas. Carbon monoxide is a colorless, odorless, and tasteless gas that is slightly less dense than air. It is toxic to hemoglobic animals when encountered in concentrations above about 35-ppm. Carbon monoxide is produced from the partial oxidation of carbon-containing compounds. It forms when there is not enough oxygen to produce carbon dioxide ($CO_2$), such as when smelting iron. In the presence of atmospheric concentrations of oxygen, carbon monoxide burns with an invisible blue flame, producing carbon dioxide.

It is therefore very important to control and stop errant carbon monoxide process gases that pass through gaps between stave coolers, cracks in any castable refractory cement, and gas-tight seals welded to join the steel containment shells at the external coolant pipe-hose connections and stave support fasteners.

Copper is highly preferred over cast iron for stave coolers because the thermal conductivity of copper is so much better than cast iron. But copper is relatively soft and easily abraded, compared to cast iron. The churning and roiling of the "coke" inside a furnace is highly abrasive to the walls, especially in the upper reaches. Copper stave coolers must therefore have some sort of abrasion resistant facing incorporated into their hot faces if they are to survive in a campaign that extends ten years or more.

Figure 1A:
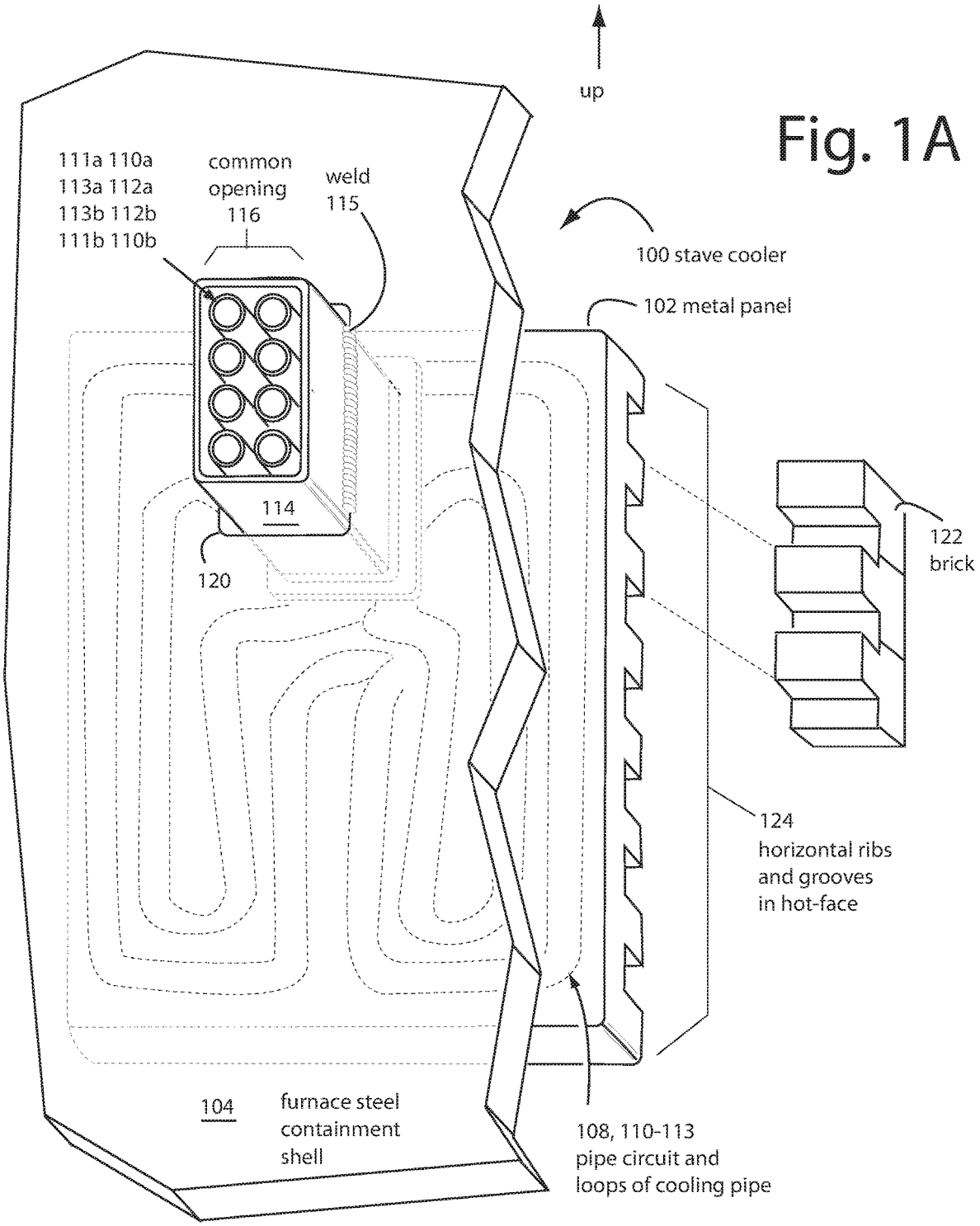
FIG. 1A is a backside perspective cutaway view diagram of a stave cooler embodiment of the present invention intended to show how a metal collar attached to the metal panel provides a means to both hang and support the weight and to conduit the coolant pipe inlets/outlets through a common opening.
Figure 1B:
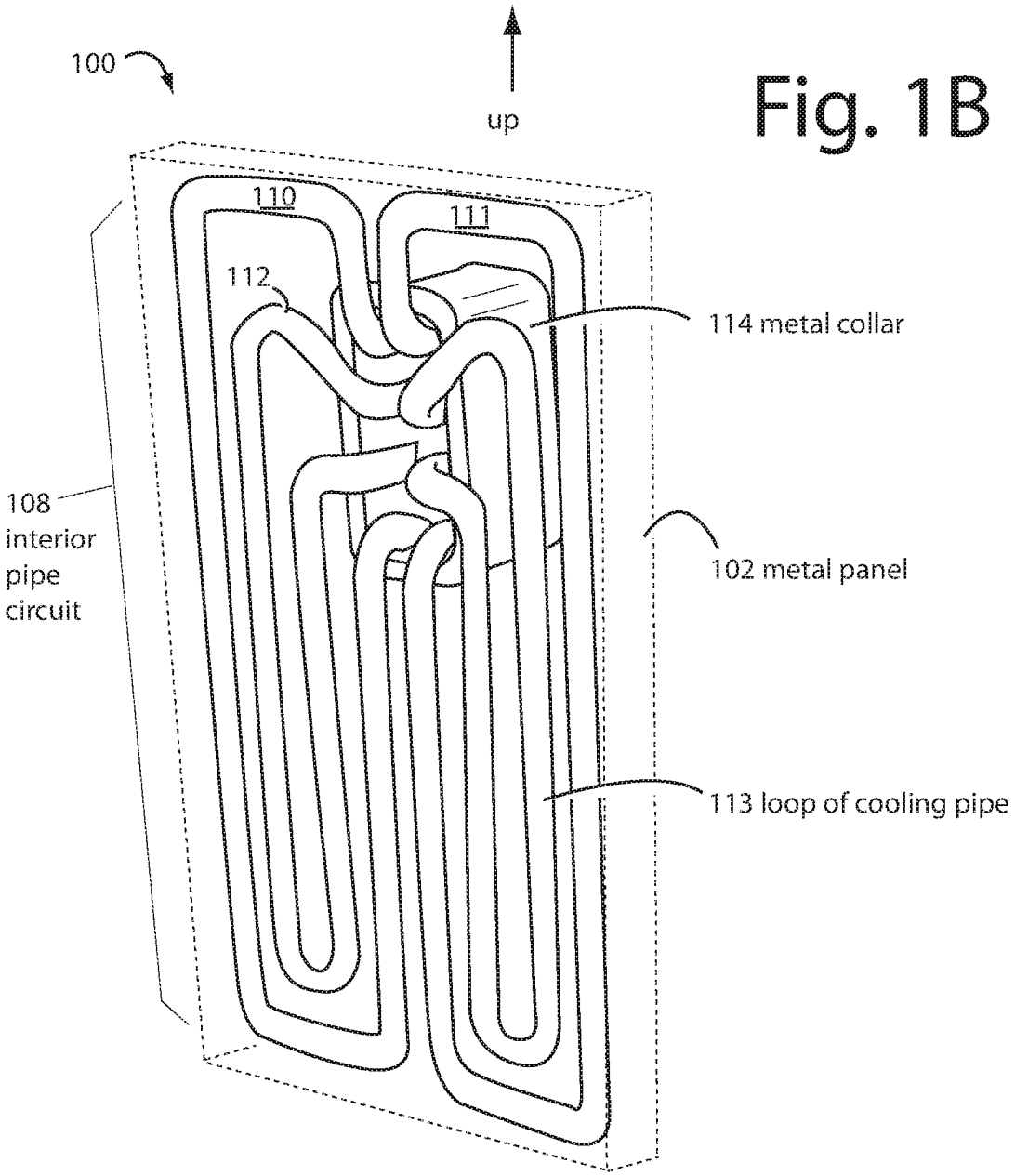
FIG. 1B is a hot-face perspective view diagram of the stave cooler of FIG. 1A and shows four loops of pipes with their respective inlet/outlet ends gathered and passed through the metal collar.

FIGS. 1A and 1B represent a stave cooler in an embodiment of the present invention 100 for a furnace that includes a metal panel 102 configured to lay vertically between the inside of a furnace containment shell 104 and any inner liner of castable cement, slag/matte, or refractory brick 106. An interior pipe circuit 108 is fully disposed within the metal panel 102 and includes at least one individual and mechanically independent loop of cooling pipe 110-113. Each loop of cooling pipe 110-113 is provided with an inlet end 110*a*-113*a* and an outlet end 110*b*-113*b* for a circulating liquid coolant that is passed externally through the furnace containment shell 104.

A metal collar 114 with a perimeter wall of sufficient height to fully penetrate the furnace containment shell 104 is attached at one end to the metal panel 102 and extends in height away from the metal panel. Such attachment must later be made gas-tight by a mounting weld 115. All the inlet and outlet ends 110*a*-113*a*, 110*b*-113*b* of all independent loops of pipe 110-113 are gathered through a common opening 116. Such enables their respective portions of a circulating liquid coolant to pass externally through the furnace containment shell 104 via the metal collar 114.

Metal collar 114 should be filled or at least partially filled with cast metal of metal panel 102, castable, flexible refractory blanket, fiber or caulking. The objective here is to seal against process gases escaping.

Such construction relieves the loops of cooling pipe 110-113 and their inlet ends 110*a*-113*a* and outlet ends 110*b*-113*b* of the stresses of supporting the weight of cooling stave 100 after being installed inside furnace containment shell 104.

In one embodiment, the metal panel 102 substantially comprises a single copper casting, and interior pipe circuit 108 is cast within. The one end of the metal collar 114 attached to the metal panel 102 is attached by casting and embedding it inside the metal panel. The metal collar 114 substantially comprises carbon steel, and numbers no more than one per metal panel 102. In every case, the metal collar 114 provides substantially all support necessary for the weight and gas sealing of the stave cooler 100 when mounted within and through a matching single penetration 120 of the furnace containment shell 104. So, the heretofore common failures of conventional stave compensators and fasteners are substantially eliminated.

An inner liner for a furnace is built up from individual and essentially identical refractory bricks 122 that are tightly mounted, locked together, and in thermal contact with horizontal rows of ribs and grooves 124 on a "hot-face" of the metal panel 102. Ordinary and conventional refractory bricks 122 tend to temporarily swell as they receive large amounts of heat and will permanently swell as metals percolate through and condense inside. Embodiments of the present invention leverage such swellings to improve the thermal contact between the stave coolers and bricks themselves. The swelling of the bricks is deliberately constrained by the selected geometries of the containment shell interior and the horizontal ribs and grooves on the hot-faces of the stave coolers. Good choices in the types and kinds of refractory materials to use go far in tightening up all gaps and cracks.

A complete cylindrical inner liner for the furnace is thus assembled from many rows of a sufficient number of stave coolers positioned and stacked to form a complete ringed wall of cooled refractory brick lining within the furnace containment shell 104.

If the metal panel 102 and its horizontal rows 124 on a hot-face are cylindrically curved, the individual and essentially identical refractory bricks are sized and in sufficient number to more tightly press themselves together shoulder-to-shoulder as they receive any furnace heat. Such greatly improves cooling performance in the refractory brick 122 by a resulting higher contact pressure and lower thermal resistance at the cooler-brick interface around a whole horizontal ring of corresponding stave coolers 100.

Figure 2:
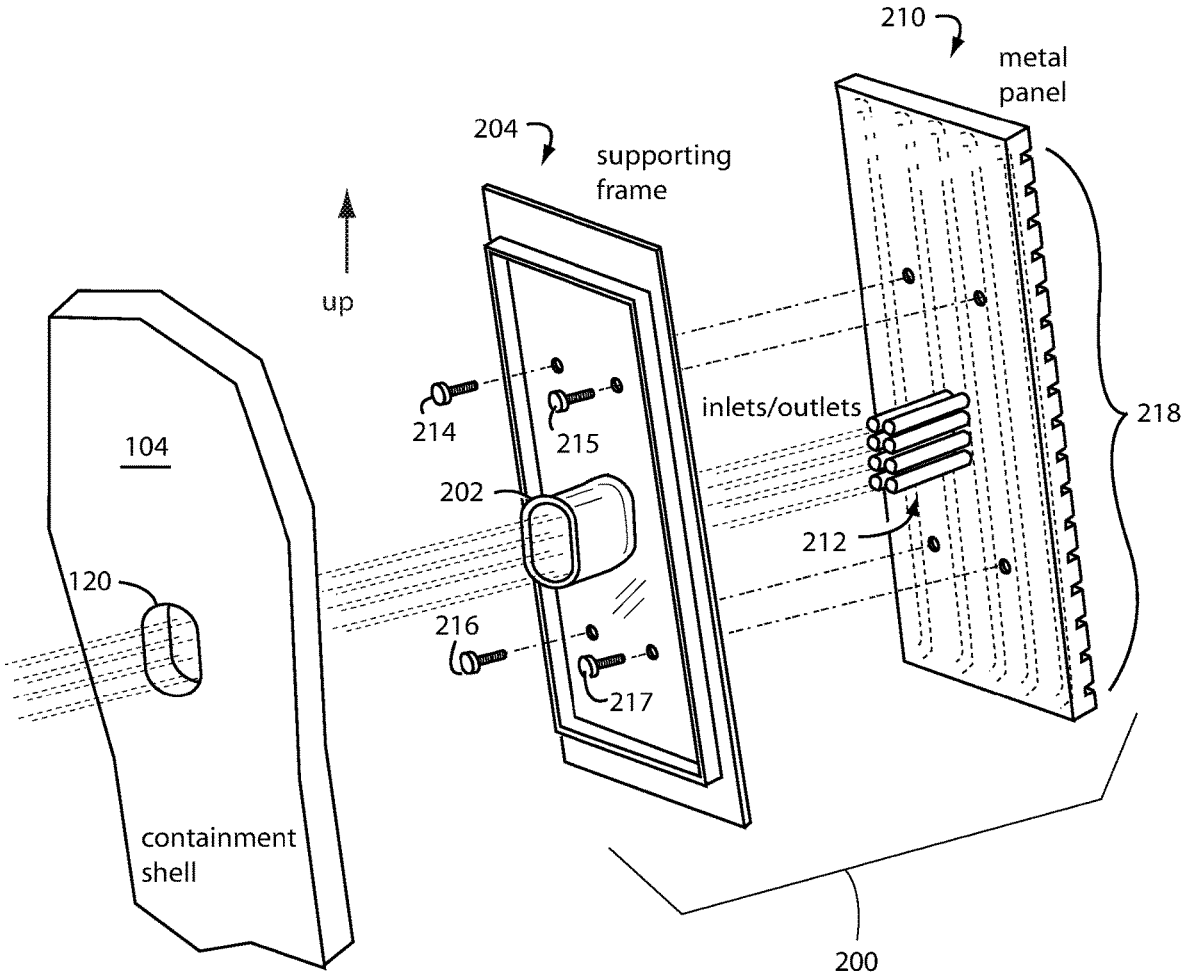
FIG. 2 is a perspective exploded assembly view diagram of an alternative stave cooler in which the metal collar is attached to a steel supporting frame on the backside.

FIG. 2 illustrates an alternative way of attaching a metal collar in a stave cooler 200. A metal collar 202 made of steel is welded to a steel supporting frame 204. A stiffener 206 welded to the back of supporting frame 204 reduces flexing and helps sealing materials to maintain a gas tight assembly to the containment shell 104. The metal collar 202 welds inside penetration 120 as did stave cooler 100 (FIGS. 1A and 1B).

The use of steel supporting frame 204 allows a much thinner and less expensive metal panel 210 because of the added strength. This is especially true when metal panel 210 is substantially comprised of billet or cast copper in high levels of metal purity. A group of inlet/outlet cooling pipe ends 212 pass through metal collar 201 when the supporting frame 204 is attached with fasteners 214-217.

Refractory brick, castable cement, and/or slag/matte are best retained by ribs/grooves in a hot-face 218.

Figure 3:
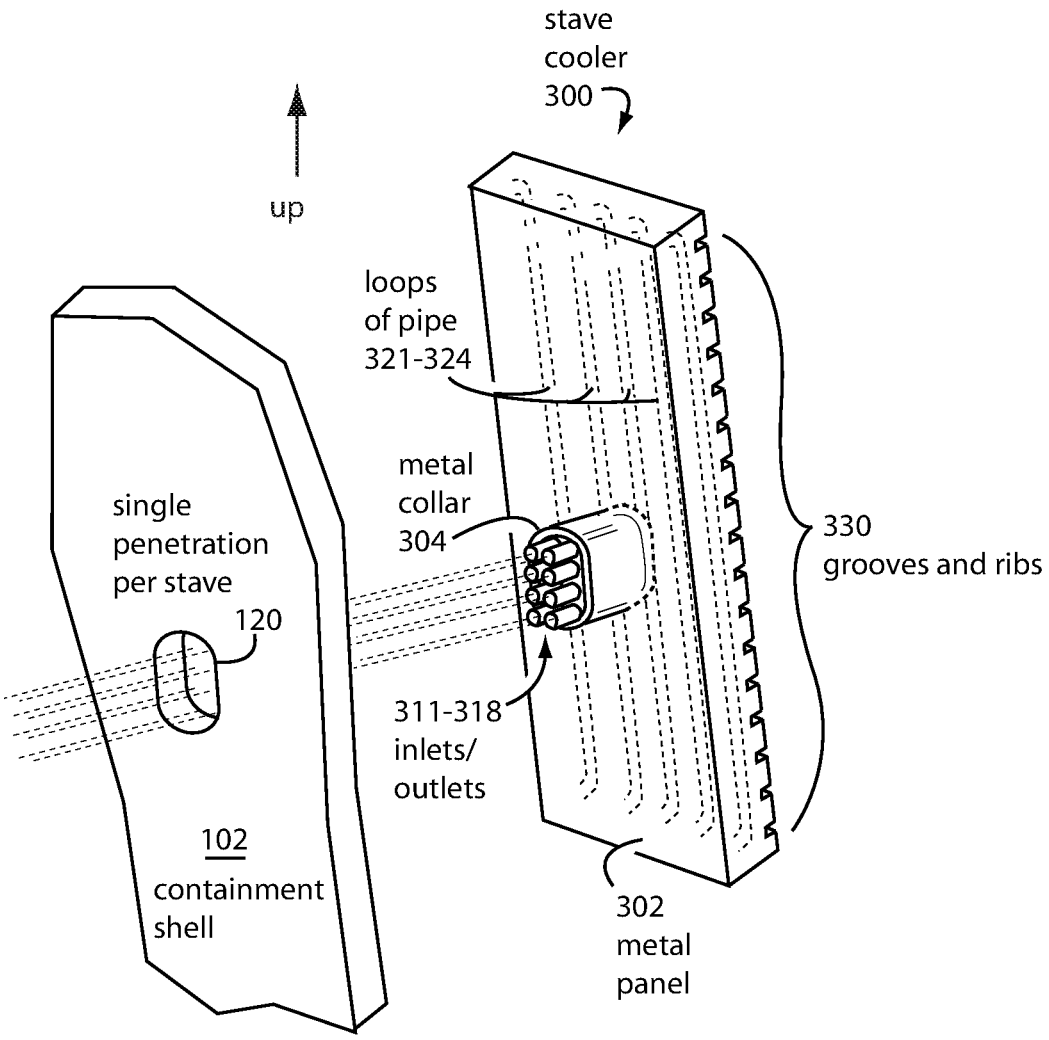
FIG. 3 is a perspective exploded assembly view diagram of a further alternative stave cooler in which the metal collar is partially embedded into the backside while casting the metal panel.

FIG. 3 illustrates a still further alternative way of attaching a metal collar in a stave cooler 300. A metal collar 302 made of steel is partially embedded at one end during casting of a pure copper metal panel 304. Several inlets/outlets ends 311-318 of coolant pipes 321-324 pass inside the perimeter walls of metal collar 304 and ultimately through penetration 120 of containment shell 102.

Refractory brick, castable cement, and/or slag/matte are retained by horizontal ribs/grooves/pockets in a hot-face 330.

Figure 4:
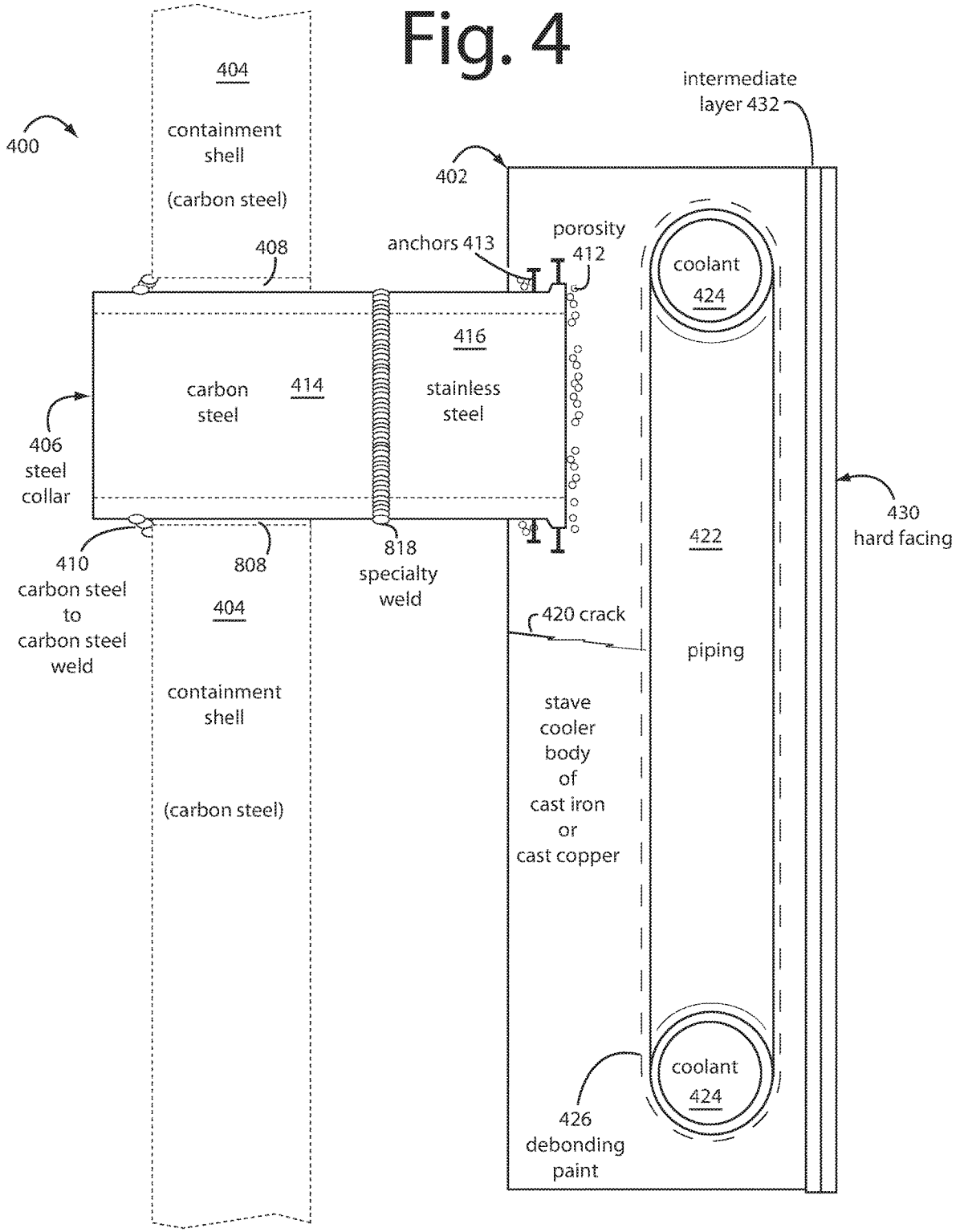
FIG. 4 is a cross sectional view diagram of a stave cooler embodiment of the present invention hanging inside a steel containment shell. This view details the location of a "specialty weld" that joins carbon steel and stainless steel (or nickel alloy) parts of a steel collar embodiment of the present invention.

FIG. 4 concerns itself with the characteristics of various metals to alloy or not alloy with other metals. Associated with that is how well metals will physically bond with other metals.

A stave cooler installation 400 in an embodiment of the present invention mounts a cast-copper stave cooler 402 inside a carbon-steel containment shell 404. A single steel collar 406 embedded at one end into stave cooler 402 provides the entire support of the weight by hanging from a single penetration 408 in containment shell 404. A carbon-steel-to-carbon-steel weld 410 stoppers process gas inside from passing through penetration 408.

Carbon steel normally does not bond well with copper, and the two often produce a "dirty" interface between them that causes gassing and a porosity 412 during fabrication. This produces a weakness in the joint. Anchors 413 can be added to the inside or outside or both of the steel collar 406 to improve its mechanical lock with the stave body casting.

Embodiments of the present invention join together a carbon-steel collar part 414 to a stainless-steel or nickel alloy collar part 416 with a "specialty weld" 418 that together serve as steel collar 406.

Collar part 416 typically comprises either a 300-series austenitic stainless steel or a nickel alloy. Type-304 and type-316 are both acceptable, as are type-309 and type-310. Referring to these as "300-series austenitic stainless" is a bit clearer to most. The 400-series martensitic stainless steels have a coefficient of thermal expansion close to the low carbon steel used in steel shell plate, but such can easily suffer from embrittlement during the casting process. Duplex grades, those half way between the 300-grades and 400 grades of stainless steel, could also be used effectively for collar part 416. A dirty interface and porosity 412 will be avoided with the use of collar part 416 because the copper contacts only the stainless steel or a nickel alloy. However, the bonding strength of stainless steel or nickel alloy with copper is no better than it is for carbon steel.

Welding austenitic stainless steels (collar part 416) to carbon and low alloy steels (collar part 414) are conventional in the process and construction industries. The British Stainless Steel Association (Sheffield, UK) says dissimilar metal welds involving stainless steels can be done using most full fusion weld methods, including tungsten inert gas (TIG) and metal inert gas (MIG). Welds using consumable fillers allow for better control of joint corrosion resistance and mechanical properties.

When deciding which weld filler to use, the joint (at weld 418) is considered to be stainless, rather than the carbon steel. Over-alloyed fillers, e.g., with increased nickel content, can avoid dilution of the alloying elements in the fusion zone of the parent stainless steel.

Common combinations of dissimilar steels involving stainless steel include plain carbon or low alloy structural grades and austenitic stainless steel grades such as 1.4301 (304) or 1.4401 (316). Carbon and alloy steels less than 0.20% C do not normally need a preheat when being welded to austenitic stainless steels. Carbon and alloy steels with carbon levels over 0.20% may require a preheat. High restraint joints, where the material thickness is over thirty millimeters, should also be preheated. Temperatures of 150° C. are usually adequate. Carbon steels are more prone to hydrogen associated defects than are austenitic stainless steels, and so the welding consumables must be dry. Standard 308 type filler can be used for joining a stainless steel to carbon steel, and the more highly alloyed fillers, such as the 309 type (23 12L to BS EN 12072) are preferred. Cracking in the weld dilution zone can be a problem if a 308 type (19 9L to BS EN 12072) filler is used, because there can be too little ferrite, and martensite may form on cooling.

In higher temperature service, the differences in thermal expansion rates of the steels and filler can lead to thermal fatigue cracking. Long exposure times at these temperatures to welds with enhanced ferrite levels can result in embrittlement due to sigma phase formation. Nickel based fillers, such as Inconel, can produce better welds with lower thermal expansion rates than do the stainless steel fillers.

"Specialty weld" 418 thus cannot be done effectively outside the shop. But weld 410 can always be done on site.

Cracking 420 inside the body of stave cooler 402 can lead to cracking of internal piping 422 and a loss of its circulating liquid coolant 424. Coolants 424 comprised of water can be the cause of BLEVE and serious explosions and loss of life. So in the case of cast iron used in the body of stave cooler 402, a de-bonding paint 426 is applied to internal piping 422 during casting to prevent crack propagation.

Crack propagation into internal piping 422 is not a problem when copper casting is used for the body of stave cooler 402, and so de-bonding paint 426 is not necessary.

A hard facing 430 of abrasion resistant material can be applied as a thin layer on the hot face of stave cooler 402 to protect the stave cooler from wear and increase its campaign life. Depending on the exact materials used in hard facing 430, an intermediate layer 432 may be needed to improve bonding and durability.

The materials needed to intermediate between the materials of a more outer coating and a copper base or cast iron base are generally understood by artisans. However, which materials and what deposition processes are needed to apply such hard faces to our stave cooler base substrates of copper or cast iron are limited to those that through empirical experience produce the longest campaign lives.

Hard facing 430 here comprises an alloy of nickel and chromium, and/or molybdenum, and/or niobium.

Sandmeyer Steel Company (Philadelphia, Pa.) says its Alloy 625 is an austenitic type of crystalline structured nickel-chromium-molybdenum-niobium alloy with outstanding corrosion resistance and high strength over a wide range of temperatures from cryogenic to 1800° F. (982° C.)

The strength of Alloy 625 derives from a solid-solution hardening of the nickel-chromium matrix in the presence of molybdenum and niobium. Precipitation-hardening treatments are not required.

Alloy 625 is outstanding in a variety of severe operating environments in its resistance to pitting, crevice corrosion, impingement corrosion, intergranular attack, oxidation and carburization in high temperature service, and is practically immune to cracking caused by chloride stress corrosion.

Alloy 625 can be easily welded to copper and processed by standard shop fabrication practices.

Coolers principally cast from pure copper and that circulate water inside provide the best in high performance and are able to work in the severe environments of modern copper and iron furnaces. However, the relatively soft copper needs protection from wear, and the water in the coolants needs to be kept from BLEVE.

Wear in these furnaces is a combination of abrasion, impacts, metallic, corrosion, heat and other effects.

Castable cement slathered on the hot face surfaces of copper stave coolers can protect the copper from wear during use. The relatively cool surfaces precipitate and freeze jackets of accretion from the melt, and these form a principal wear barrier.

Other nickel-chrome alloys suited for abrasion resistance include Alloy-122, Alloy-622, Alloy-82, and Alloy-686. Some nickel-chrome alloys particularly suited for corrosion resistance include Alloy-122, Alloy-622, Alloy-686, and NC 40/20. In each case, minimum nickel content should be 55%, minimum chrome content 18%, and maximum iron content should be 6%.

But sometimes the frozen accretions will crack, scale, separate, and sluff off to expose the bare copper surface. New patches will freeze in place immediately, but the process and brief exposures can cause significant wear over the campaign life. Grooves, texturing, and pockets embedded as contour features in the hot face surfaces help to retain both castable cement and frozen accretions.

Metal and refractory brick inserts are also conventional ways that copper stave coolers have been shielded from wear. But the machining needed to finish off the grooves, ribs, and channels needed to retain the metal and refractory brick inserts is expensive. It is also very challenging to keep the inserts in tight firm contact with the stave cooler. Any looseness in the fit will allow the inserts to get too hot and that will accelerate wear.

Cast copper embodiments of stave coolers 100, 200, 300, and 400 all preferably comprise a small grain copper with a balance of factors like molten metal heat, cooling rate after the pour, alloys added to improve strength and control grain sizes, deoxidants, optimized pipe bonding with the casting, and not falling below an electrical conductivity of 80% IACS so its thermal conductivity will be relatively free of thermal resistance and gradients.

The operational safety of stave cooler embodiments of the present invention can be improved by circulating liquid coolants within them that are water-based but nevertheless intrinsically safe from boiling liquid expanding vapor explosion (BLEVE). Essentially, no more than 50% water is blended in with a single phase glycol alcohol like methanol ethylene glycol (MEG). The MEG operates as a desiccant and binds the water in a physical absorption. The present inventor, Allan MacRae, has already disclosed the particulars of this in U.S. patent application Ser. No. 15/968,272, filed May 1, 2018, and titled, WATER-BASED HEAT TRANSFER FLUID COOLING SYSTEMS INTRINSICALLY SAFE FROM BOILING LIQUID EXPANDING VAPOR EXPLOSION (BLEVE) IN VARIOUS PYROMETALLURGICAL FURNACE APPLICATIONS.

Every corner and edge of our stave coolers is eased and blunted to reduce cracking and separation of castable cement that is typically packed around and behind stave coolers to prevent outflows of hazardous process gases past them.

Water makes an excellent choice as a coolant because its low viscosity makes it easy to pump and its high specific heat means that coolant pumping volumes and speeds can be kept as low as is possible. A balanced combination of these considerations means the pumps in water-based cooling systems can be economized. But introducing water-based coolants into high heat ferrous and non-ferrous pyrometallurgical furnaces runs a risk of boiling liquid expanding vapor explosion (BLEVE).

Figure 5:
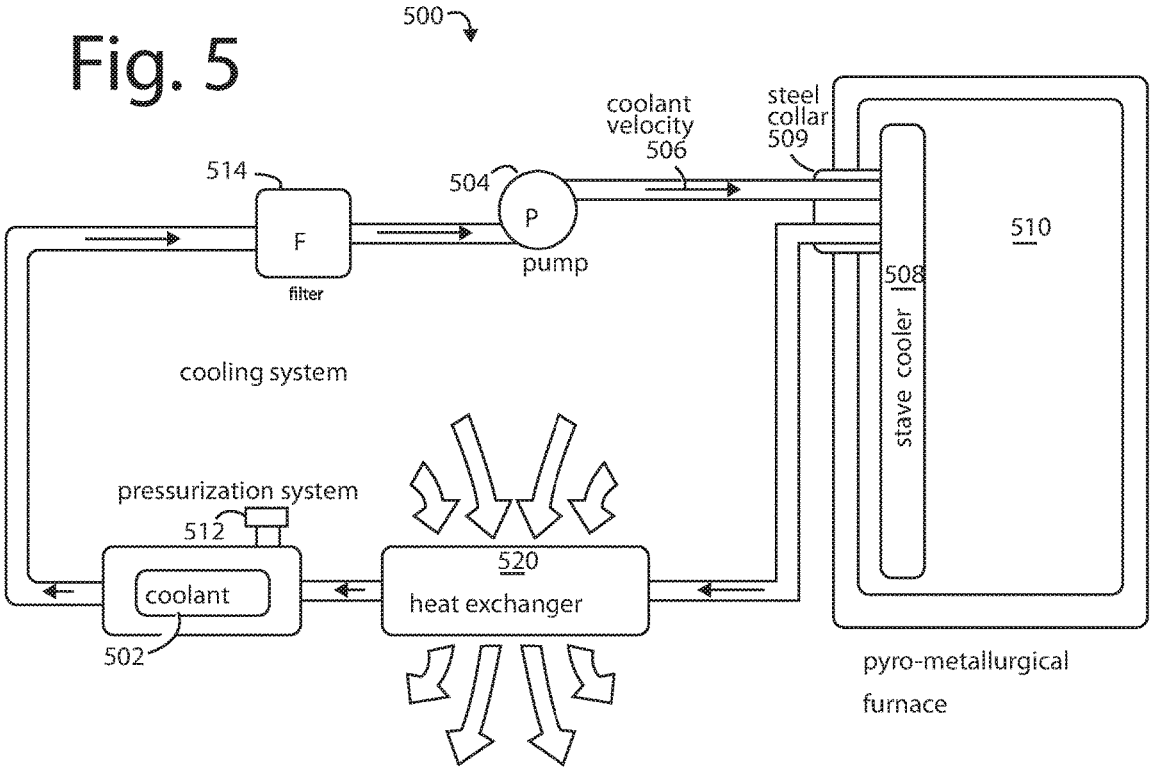
FIG. 5 is a functional block diagram in a schematic type view of a cooling system embodiment of the present invention that is intrinsically safe from boiling liquid expanding vapor explosion (BLEVE) should any of its liquid, water-based coolant escape or leak into a pyrometallurgical furnace.

FIG. 5 represents a water-based cooling system 500 in an embodiment of the present invention that is intrinsically safe from BLEVE. A heat transfer fluid mixture 502 comprises water, glycol alcohol, and corrosion inhibitors in a homogeneous solution that are circulated around in a closed loop by a liquid pump 504. The percentage of water used in the heat transfer fluid mixture 502 has both high and low limits. In general, water can in this use can range from 10% to 50%.

The minimum percentage of water that should be used is limited by the adverse impacts of increasing viscosity and reduced specific heat that bear on the acquisition and operating costs of liquid pump 504. As viscosity increases, it requires a greater pumping effort and a stronger liquid pump 504 to maintain a minimum coolant velocity 506. And as the specific heat of heat transfer fluid mixture 502 is decreased by diluting the water, the greater will be the pumping effort required of a larger capacity liquid pump 504 to maintain a higher, minimum level coolant velocity 506 that will compensate for the inefficiency. Being able to use a smaller sized pump can produce a large savings in capital costs, given the nature of the severe environmental application of such pumps.

In practice, the heat transfer fluid mixture must have a room-temperature viscosity of less than 20 mPa·s. And the heat transfer fluid mixture 502 must have a specific heat greater than 2.3 kJ/kg.K. Otherwise, the requirements for a suitable pump 504 become unreasonable and/or unmanageable.

The maximum percentage of water that can be used safely is limited by the risks of BLEVE. Short of that threshold, the mixed coolant blend 502 will burn, and not BLEVE, if it escapes from a cooler 508 with a steel collar 509 into a high heat ferrous or non-ferrous pyrometallurgical furnace 510. All the coolant circulation for each stave cooler 508 passes through in a single grouping within its respective steel collar 509.

Intermolecular bond types determine whether any two chemicals are miscible, that is, whether they can be mixed together to form a homogeneous solution. Here, the water and glycol in the heat transfer fluid mixture 502 easily join together in a homogeneous solution. When two chemicals like water and glycol mix, the bonds holding the molecules of each chemical together must break, and new bonds must form between the two different kinds of molecules. For this to happen, the two must have compatible intermolecular bond types. Water and MEG glycol do. The more nearly equal in strength the two intermolecular bond types are, the greater will be the miscibility of the two chemicals. Usually there is a limit to how much of one chemical can be mixed with another, but in some cases, such as with $CH_3OH$ (MEG) and $H_2O$ (water), there is no limit and any amount of one is miscible in any amount of the other.

As a consequence, the percentage of water in the heat transfer fluid mixture 502 will have a practical range between 10% and 50%. The optimum percentage of water plus corrosion inhibitors in the heat transfer fluid mixture 502 is generally about 25%. No excess water is left unabsorbed to support a BLEVE.

The heat transfer fluid mixture 502 is circulated in a closed system and pressurized by a pressurization system 512. Typical pressures run 2-7 bar. Raising the pressure inside the closed system raises the boiling point of the heat transfer fluid mixture 502. The minimum boiling point of the heat transfer fluid mixture 502 under pressure should be no less than 175° C.

A particulate filter 514 is used to remove rust particles, exfoliated mineral scale, and other solid contaminants from the heat transfer fluid mixture 502 as it circulates.

A chiller or heat exchanger 520 is used to remove and dispose of the heat gained by the heat transfer fluid mixture 502 in circulation, e.g., a cooler 508 inside furnace 510. Such chillers and heat exchangers are conventional.

Although FIG. 5 shows only a stave cooler 508, such could just as well be a panel cooler, or a cooling jacket for a top submerged lance (TSL), torch, or Tuyere to receive the benefits of intrinsically safe operation from BLEVE. Conventional applications dangerously bring water-based liquid coolants into close proximity with pyrometallurgical furnaces.

Figure 6B:
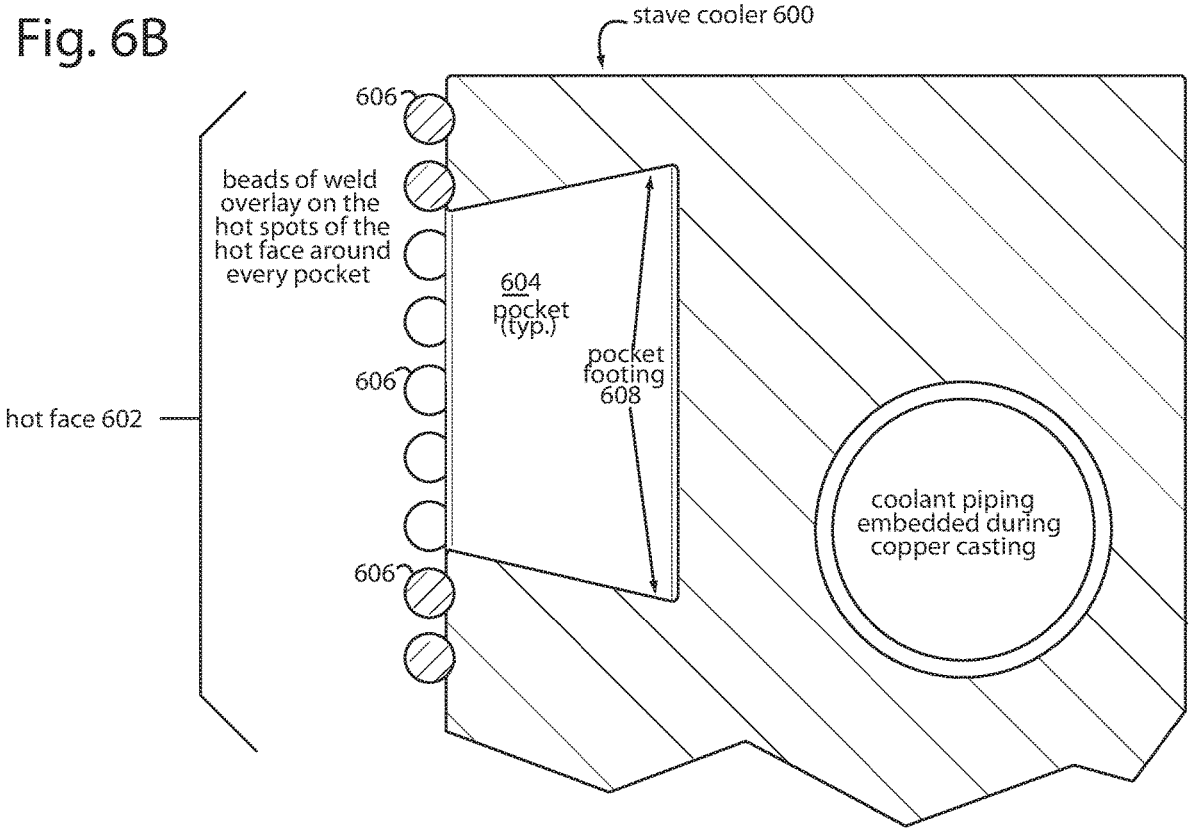
FIG. 6B is a cross-sectional view of one pocket of FIG. 6A taken along line 6B-6B.
Figure 6A:
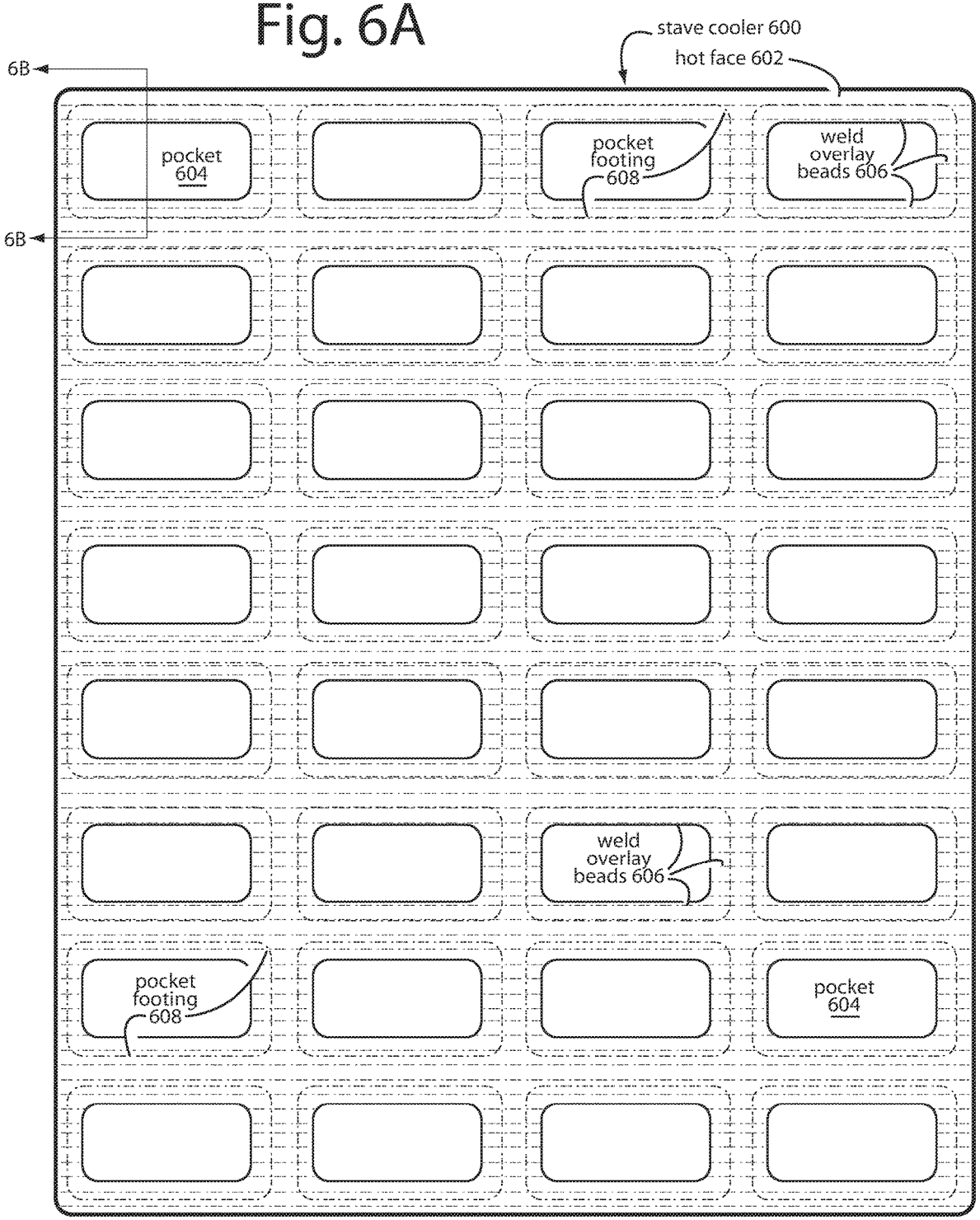
FIG. 6A is a plan view diagram of a hot face of a stave cooler fitted with pockets and hardfacing welding overlays.

FIGS. 6A and 6B represent applications in which copper stave coolers 600 and their hot faces 602 especially cannot be protected with refractory brick or metal inserts for practical or economic reasons. A number of pockets 604 are distributed on hot face 602. A hard facing weld overlay 606 is applied in bead, crosshatch, or weave patterns on the more exposed raised perimeters of hot face 602 surrounding each pocket 604.

Various welding techniques can be used to fuse both similar and dissimilar materials to the copper metal surface of stave coolers 802 and 600. The hard facing 830 can be applied by welding beads 606 in groups in those portions of the hot face surface more subject to wear than others. In some cases, that will mean the entire surface will require a weld overlay, e.g., no pockets.

An improved copper stave cooler embodiment of the present invention has increased wear resistance to at least one of abrasion, impact, metal-to-metal contact, heat, and corrosion on an included hot face surface. A hardfacing comprising at least one alloy of nickel and chromium is fused on by welding.

Sometimes to less than the entire surface, and only on those portions of the hot face surface predetermined to be more exposed during use to wear than are any other portions. The hardfacing is typically applied as a weld overlay of molten metal in an inert shield gas.

In FIGS. 6A and 6B, these copper stave coolers 600 can be further improved by including a plurality of castable cement retention pockets 604 disposed across the surface of the hot face 602. Each such pocket 604 includes inwardly tilting, shallow walls and footings 608 that operate to better retain a castable cement filling when in use. A perimeter of raised and more exposed copper base material surrounds each of the plurality of pockets. So, the application of such hardfacing is economized by placing it in bead patterns 606 on only the raised and more exposed copper base material of the perimeter.

Preferably, the copper base material to receive welding overlays is the equivalent of UNS C12000 if wrought or UNS C81100 if cast, which includes deoxidants and low residual phosphorous that promote good welds, reduced copper grain size, an electrical conductivity of at least 80% IACS, and improved embrittlement resistance during welding.

A stave cooler that has one-only through-bulkhead neck that is always collared in an appropriate steel is useful in the industry to control process gas sealing and containment. All of the coolant piping from all the coolant circuits within a single rectangular copper body must pass through in a single group to then connect externally outside the steel containment shell. This minimizes the adverse effects of thermal expansion and contraction to manageable levels. Gathering the individual pipe inlet/outlet connections through the furnace shell limits the deteriorating forces at work.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A stave cooler for a furnace, comprising:

a metal panel configured to fit between the inside of a furnace containment shell and any inner liner;

an interior pipe circuit fully disposed within the metal panel and including at least one individual and mechanically independent loop of a pipe or a drilled passageway each with an inlet end and an outlet end for a circulating liquid coolant passed externally through the furnace containment shell;

a metal collar with a perimeter wall attached at one end to the metal panel and extending in height away from the metal panel;

a common through opening within the metal collar through which all inlet and outlet ends of all independent loops of pipe are enabled to pass their respective parts of the circulating liquid coolant externally through the furnace containment shell;

the one end of the metal collar attached to the metal panel is fixed by casting and embedding it inside the metal panel;

the metal collar substantially comprises steel and numbers no more than one per metal panel; and the metal collar provides substantially all support necessary for the weight and gas sealing of the stave cooler when mounted within and through a matching single penetration of the furnace containment shell;

wherein, process gas sealing failures of conventional staves are eliminated.

2. A stave cooler for a furnace, comprising:

a metal panel configured to fit between the inside of a furnace containment shell and any inner liner;

an interior pipe circuit fully disposed within the metal panel and including at least one individual and mechanically independent loop of a pipe or a drilled passageway each with an inlet end and an outlet end for a circulating liquid coolant passed externally through the furnace containment shell;

a metal collar with a perimeter wall attached at one end to the metal panel and extending in height away from the metal panel;

a common through opening within the metal collar through which all inlet and outlet ends of all independent loops of pipe are enabled to pass their respective parts of the circulating liquid coolant externally through the furnace containment shell;

the metal panel substantially comprises a single copper casting;

the interior pipe circuit is cast within the metal panel as a pipe or a drilled passageway;

the one end of the metal collar attached to the metal panel is attached by casting and embedding it inside the metal panel;

the metal collar substantially comprises carb n steel and numbers no more than one per metal panel; and the metal collar provides substantially all support necessary for the weight and gas sealing of the stave cooler when mounted within and through a matching single penetration of the furnace containment shell;

wherein, process gas sealing failures of conventional stave are eliminated.

3. The stave cooler of claim 1, wherein:

a hot-face included in the metal panel configured to support tightly fitted and locked together horizontal rows of essentially identical refractory bricks in thermal contact with one another and the hot-face;

wherein a complete inner liner for the furnace is organizeable from rows of a number of stave coolers laterally positioned and stacked to assemble a complete cylindrical wall of cooled refractory brick lining within the furnace containment shell.

4. The stave cooler of claim 3, wherein:

the metal panel and its horizontal rows on a hot-face are cylindrically curved to fit a radius of a cylindrical furnace containment shell; and the individual and essentially identical refractory bricks are sized and in number to more tightly press themselves together shoulder-to-shoulder as they swell under any furnace heat, and thereby improve refractory brick cooling by a resulting higher contact pressure and closing of gaps and cracks with each hot-face of a corresponding stave cooler.

5. A stave cooler, comprising a main body panel of cast copper in which are fully disposed a number of loops of cooling pipes each loop having an inlet end and an outlet end, and all of which inlet and outlet ends are turned up together in a single grouping;

a hollow steel support collar with opposite openings and attached at one such opening to the main body panel of cast copper such that the single grouping of inlet and outlet ends is fully surrounded and accessible for external coolant plant connections through a second such opening;

wherein a single such hollow steel support collar is sufficient to support the entire weight of the stave cooler inside a furnace shell through a one-per-stave penetration of the furnace shell and that thereby makes the single grouping of inlet and outlet ends externally accessible for coolant plant connections that can pass through the second such opening;

wherein the single grouping of inlet and outlet ends is shielded from supporting the weight of the stave cooler and are thereby less susceptible to cracking and water leaks.

* * * * *